United States Patent [19]

Merz

[11] Patent Number: 4,517,545

[45] Date of Patent: May 14, 1985

[54] THICK FILM TEMPERATURE SENSITIVE DEVICE AND METHOD AND MATERIAL FOR MAKING THE SAME

[75] Inventor: Kenneth M. Merz, Gladwyne, Pa.

[73] Assignee: TRW Inc., Redondo Beach, Calif.

[21] Appl. No.: 341,781

[22] Filed: Jan. 22, 1982

[51] Int. Cl.[3] ..... H01C 7/04; B44D 1/20; C23B 5/62

[52] U.S. Cl. ..... 338/25; 338/308; 252/513; 252/514; 427/101

[58] Field of Search ..... 338/25, 308; 427/101, 427/126.1, 126.2, 126.3, 126.5, 125; 252/512, 513, 514, 518

[56] References Cited

U.S. PATENT DOCUMENTS

| | | | |
|---|---|---|---|
| 3,644,863 | 2/1972 | Tsuei | 338/25 |
| 3,679,606 | 7/1972 | Short | 252/514 X |
| 3,781,749 | 12/1973 | Illes et al. | 338/25 |
| 3,859,128 | 1/1975 | Burks et al. | 252/514 X |
| 4,051,074 | 9/1977 | Asada | 252/512 X |
| 4,148,965 | 4/1979 | Jelli | 427/444 |
| 4,222,025 | 9/1980 | Illes et al. | 338/25 |
| 4,282,507 | 8/1981 | Tindell et al. | 338/25 |
| 4,378,409 | 3/1983 | Wahlers et al. | 338/308 X |

FOREIGN PATENT DOCUMENTS

| | | | |
|---|---|---|---|
| 2002175 | 2/1979 | United Kingdom | 338/25 |

*Primary Examiner*—Roy N. Envall, Jr.
*Assistant Examiner*—C. N. Sears
*Attorney, Agent, or Firm*—John T. Wiedemann; Jacob Trachtman

[57] ABSTRACT

A thick film temperature sensitive device and method of making the same, comprising the steps of applying to the surface of a substrate and firing a resistance material comprising a mixture of glass frit and particles containing palladium and iron. The mixture is fired in a non oxidizing, neutral, or reducing atmosphere at a temperature between 700° C. and 1100° C. at which the glass frit softens. When cooled, a device is provided with a glass film strongly bonded to the substrate and having dispersed therein conductive metal particles of an alloy of palladium and iron. The device provides a relatively high positive temperature coefficient of resistance, a relatively high resistivity, and a resistance to temperature characteristic which is highly linear, and can be processed by spiralling and terminated by the use of electroless plating. Further, the palladium and iron are present in the mixture in an amount having a total weight between about 15% and 65%, and the glass frit being present in an amount between 35% and 85% by weight.

56 Claims, 2 Drawing Figures

THICK FILM TEMPERATURE SENSITIVE DEVICE AND METHOD AND MATERIAL FOR MAKING THE SAME

BACKGROUND OF THE INVENTION

The present invention relates to a thick film temperature sensitive device, and more particularly to an electrical temperature sensing device of a vitreous enamel resistor type having a relatively high positive temperature coefficient of resistance, a relatively high resistivity, and a resistance to temperature characteristic which is highly linear, and a method and material for making the same.

In general, thick film temperature sensing devices of the vitreous enamel resistor type comprise a substrate having a film of glass and particles of a conductive material embedded in and dispersed throughout the glass film. The devices are made by first forming a mixture of a glass frit, and particles of the conductive material. The mixture is applied to substrates and fired at a temperature at which the glass frit softens. Certain vitreous resistors such as those utilizing precious metals and precious metal oxides are made by firing in an oxidizing atmosphere, while other vitreous resistors such as those using non precious metals, and non precious metal oxides, borides and nitrides, are formed by firing in a non-oxidizing environment. When cooled, the glass solidifies to form the resistors which have a glass film with the conductive particles therein.

In order to provide electrical connections to the device, it is desirable to provide a conductive termination at each end of their resistance films. Heretofore, as disclosed in U.S. Pat. No. 3,358,362 issued Dec. 19, 1967, terminations for vitreous enamel resistors have been provided by the electroless plating of a film of a metal, such as nickel or copper. However, it has been found that such electroless metal film terminations are not compatible with certain vitreous enamel resistance films. In order to make electrical connections to such resistor films, a precious metal, such as silver, is usually applied by another process.

The thick film temperature sensing device having metal conducting materials which have heretofore been produced, characteristically have relatively low temperature coefficients of resistance or low resistivities of less than 1 ohm/square. Where the device provides both relatively high temperature coefficients of resistance and resistivities greater than 1 ohm/square, as when iron metal particles alone are used as the conductor, the vitreous resistance film can not be processed by spiralling to provide a device with the desired resistance. In addition to providing relatively high temperature coefficients of resistance, it is also desirable that the coefficient be positive to provide current self limiting of the device, since in such case the resistance increases with an increase in current and the resulting rise in temperature. The high resistivity is also essential so that the device can be produced with a resistance sufficiently high to provide high sensitivity to small changes in temperature. A highly linear change in resistance with temperature is also desirable over a temperature range of −55° C. to +150° C. to provide accurate temperature indications without requiring special and costly compensating networks.

SUMMARY OF THE INVENTION

Therefore, it is an object of the invention to provide a novel temperature sensing device and a method and material for making same.

Another object of the invention is to provide a novel method and material for a temperature sensing device having a relatively high positive temperature coefficient of resistance, and a method and material for making same.

Another object of the invention is to provide a novel thick film temperature sensing device of the vitreous enamel resistor type having a relatively high positive temperature coefficient of resistance and resistivity, and a method and material for making same.

Another object of the invention is to provide a novel thick film temperature sensing device of the vitreous enamel resistor type having a relatively high positive temperature coefficient of resistance and resistivity, and which can be spiraled for providing a desirable resistance for the device, and a method and material for making same.

Another object of the invention is to provide a temperature sensing device utilizing a metal alloy for providing a relatively high positive temperature coefficient of resistance, a relatively high resistivity, and a resistance to temperature characteristic which is highly linear over a range of temperatures between −55° C. and +150° C., and the method and material for making same.

Another object of the invention is to provide a novel method and material for making a high quality temperature sensing device which can be produced in a relatively safe firing atmosphere to have properties which may be controlled and easily fabricated to provide a desired resistance for the device and which utilizes less expensive materials.

Another object of the invention is to provide a novel temperature sensing device of the vitreous enamel resistor type containing a conductive phase of an alloy of palladium and iron which can be terminated by an electroless plated nickel or copper film, and a method and material for making same.

These objects are achieved by applying a coating to a substrate of a mixture of a glass frit and particles containing palladium and iron. The substrate and coating are then heated or fired in a non oxidizing, neutral or reducing atmosphere at a temperature between 700° C. to 1100° C. at which the glass frit softens. The firing atmosphere is non oxidizing, and includes for example, the neutral atmospheres provided by helium, argon, and nitrogen, and the reducing atmospheres provided by carbon monoxide and forming gas. The coated substrate is heated over a time duration depending upon the atmosphere and firing temperature for obtaining the softening and formation of a resistor glaze film. Upon cooling a glass film is formed which is strongly bonded to the substrate and has conductive particles of an alloy of palladium and iron embedded and dispersed therethroughout.

The electrical element thus formed is terminatable by a nickel or copper film applied in contact with a portion of the resistor glass film by an electroless plating process as described in U.S. Pat. No. 3,358,362.

The invention accordingly comprises the several steps of the method and the relation of one or more of such steps with respect to each of the others, and the device and its termination possessing the features, properties, and the relationships of constituents which are exemplified in the following detailed disclosure, with the scope of the invention being indicated by the claims.

For a fuller understanding of the nature and objects of the invention, reference should be had to the following detailed description taken in connection with the accompanying drawing.

DETAILED DESCRIPTION

Figure 1:
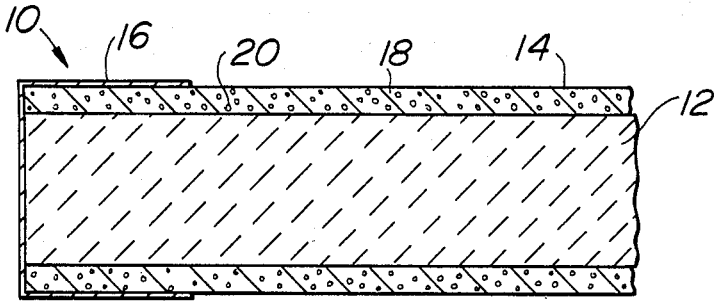
FIG. 1, is a sectional view of a portion of a temperature sensing device of the present invention showing an end terminated by an electroless plated film.

Referring to FIG. 1, a thick film temperature sensing device 10 embodying the invention comprises a substrate 12 and a resistance film 14 on the surface of the substrate. The substrate 12 may be in the form of a rod and composed of an electrical insulating material, such as provided by ceramic, alumina or steatite materials. The resistance film 14 is a vitreous enamel film which comprises a film of glass 18 having particles of a conductive material 20 embedded therein and dispersed therethroughout. The device 10 may include a metal termination film 16 in contact with the resistance film 14, which termination film may be of nickel or copper and applied by an electroless plating method.

The material 20 comprises particles of an alloy of palladium and iron which provide a metal conductor, and any other reaction products which are provided by firing a resistance material in a non oxidizing, neutral or reducing atmosphere. The resistance material comprises a mixture of glass frit and particles containing palladium and iron, to provide when fired the alloy particles of palladium and iron which are embedded in and dispersed throughout the glass film 18. The particles before being fired can contain palladium or iron or both in their metallic or oxide forms, or as an alloy thereof, or as compounds which are readily reducible to their metals of palladium or iron. The total amount of the metal present in the resistance film 14 of the conductive particles can be between 15% to 65% by weight, and preferably is between about 25% and 30% by weight. The glass used may be any glass which is substantially stable when heated in a non oxidizing, neutral or reducing atmosphere at a temperature between about 700° C. and 1100° C. during the firing of the resistance material, and which has a suitable softening temperature, i.e., a softening temperature which is below the melting point of the alloy particles. The glasses which are most preferable are the barium, calcium and other alkaline earth borosilicate glasses.

To make the resistance film 14, a resistance material is first prepared. The resistance material comprises a mixture of a fine glass frit and particles containing palladium and iron. The resistance material can be prepared by mixing together and milling the palladium and iron containing particles and the fine glass frit or by premilling the particles containing palladium and iron before they are mixed and milled with the fine glass frit. Alternatively, the resistance materials can also be produced by premilling the particles containing palladium metal and iron metal particles, and then heating them at 800° C. in a non oxidizing atmosphere to form alloy particles of palladium and iron which are then mixed with the glass frit and milled to provide the resistance material. While the amount of the palladium and iron containing particles, which may be included depends upon the amount of the resulting conductive particles required for providing the selected resistance and other properties, a metal content in an amount of 15% to 65% by weight is desirable, while an amount of 25% to 30% is preferred for obtaining relatively high temperature coefficients to resistance of 5000 parts per million/°C. and greater, sheet resistivities of 2 ohms/square and greater, and a substantially linear resistance to temperature relationship providing a deviation of resistance from linearity of less than 2% for any temperature interval of 100° C. between −55° C. and +150° C. In general, the ratio of palladium metal to iron metal may be varied with palladium metal ranging between 30% and 90% by weight and iron metal being between 10% and 70% by weight for providing a variety of glazes with different properties for the temperature sensing device. For obtaining the greatest temperature coefficients of resistance and sheet resistances, and a resistance to temperature relationship which is highly linear for the temperature sensing device, the palladium metal is present in an amount of 40% to 85% by weight of the total weight of the palladium and iron metals present.

After the glass frit and the particles containing palladium and iron have been thoroughly mixed together, as by milling in a suitable vehicle, such as water, butyl carbitol acetate, a mixture of butyl carbitol acetate and toluol, or any other well known milling vehicle, the viscosity of the mixture is adjusted for the desired manner of applying the material to the substrate 12, either by adding or removing some of the vehicle. The resistance material is then applied to the substrate 12 by any desired technique, such as brushing, dipping, spraying or screen stencil application. The coated film is then preferably dried, as by heating at a low temperature, such as 150° C. for about 10 minutes to remove the liquid medium. Next, the film may be heated at a higher temperature, of about 400° C. or higher, to burn off the vehicle. Finally, the film is fired at a temperature at which the glass softens, generally between 700° C. and 1100° C., and preferably between 800° C. and 950° C., in a non oxidizing, inert, or reducing atmosphere, such as provided by helium, argon, nitrogen, carbon monoxide or forming gas. After the resistance film 14 is formed and cooled on the substrate 12, the conductive termination film 16 can be applied to the substrate by electroless plating in the manner well known in the art.

Figure 2:
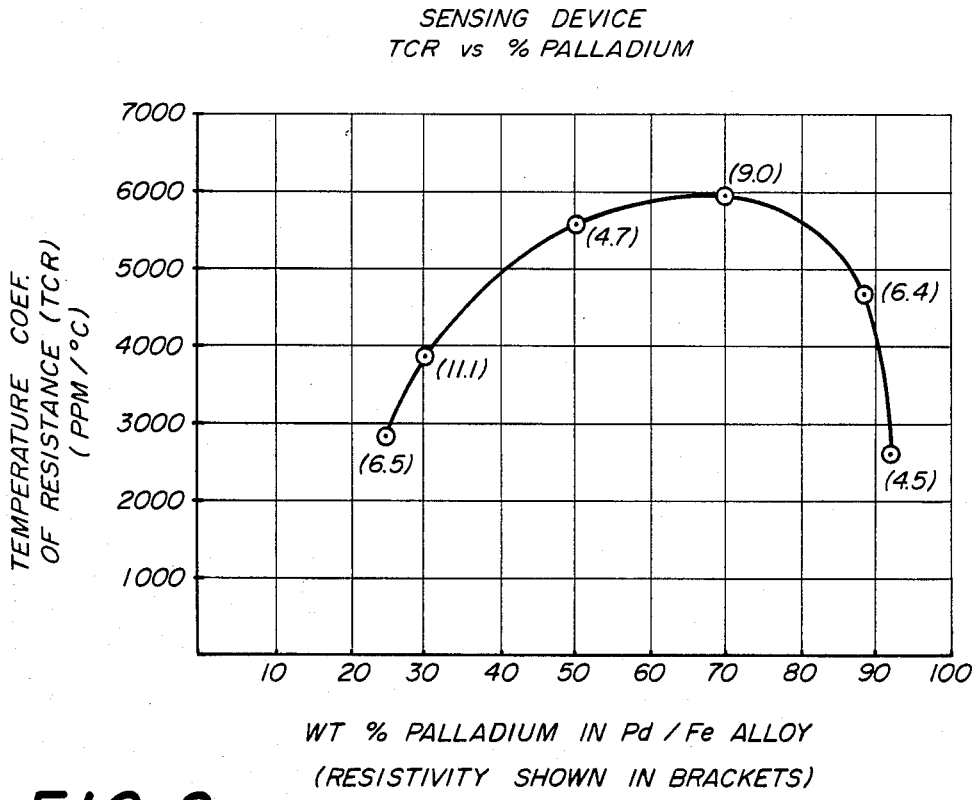
FIG. 2 is a graph of temperature coefficient of resistance (TCR) as a function of the percentage of palladium in the metal conductor of the temperature sensing device, with sheet resistivity for each point on the graph being shown in brackets.

FIG. 2 is a graph of temperature coefficient of resistance (TCR) as a function of the percentage of palladium in the metal conductor of palladium iron alloy present in the temperature sensing device. Data for providing the graph was obtained from temperature sensing devices containing a total weight of palladium metal and iron metal of between 25 and 30%, with the remainder being glass. From the graph it appears that the temperature coefficient of resistance (TCR) increases from a low value of about 2800 parts per million per °C. for 25 weight percent of palladium to a peak value of 5900 parts per million per °C. for 70 weight percent. Increasing the weight percent of palladium in the metal conductor from 70 to 92% results in decreasing the temperature coefficient of resistance. A temperature coefficient of resistance of greater than approximately 2600 part per million per °C. is shown for percentages of palladium between 25 and 92% and values of temperature coefficient of resistance greater than 5000 parts per million are shown for percentages of palladium between 40 and 85% by weight.

FIG. 2 also shows in brackets next to each point on the graph, the resistivity of the temperature sensing device corresponding to the temperature coefficient of resistance. Resistivities of at least 4.5 ohms per square are provided over the entire range of 25 to 92 weight percent of palladium, with twice that value or 9.0 ohms per square for the peak TCR value of 5900 parts per million per °C. for 70 weight percent of palladium in the palladium iron alloy.

The data is from temperature sensing devices made in accordance with the invention from resistance materials comprising palladium metal particles and iron oxide particles ($Fe_2O_3$) and glass frit of the composition described below in connection with Example III. Substrates coated with the resistance material were fired at a peak temperature of 900° over a one half hour cycle in an atmosphere of forming gas of 85% nitrogen and 15% hydrogen of volume, except that the devices having 30 and 70 weight percent of palladium were fired in a forming gas atmosphere of 95% nitrogen and 5% hydrogen by volume. The results obtained and shown in the graph of FIG. 2, however, will vary depending upon the compositions of the materials and their firing and processing conditions. The following examples will show results obtained for various resistance materials and firing and processing conditions.

EXAMPLE I

A resistance material was made by ball premilling together a mixture, by weight, of about 84% palladium metal particles and about 16% iron metal particles, in a butyl carbitol acetate medium. The particles were filtered, and then dried for 2 hours at 70° C., and heated for two hours at 825° C. in an atmosphere of carbon monoxide to form alloy particles of palladium and iron. The alloy particles were annealed for four days at 750° C. in an atmosphere of carbon monoxide, although the alloy particles can also be prepared by heating one hour at 800° C. in the reducing carbon monoxide atmosphere and without annealing. Batches of alloy particles were then mixed respectively with 80% by weight and 70% by weight of glass frit, and the mixtures were ball milled in a butyl carbitol acetate vehicle for 72 hours to provide the resistance materials. The glass frit was an alkaline earth borosilicate composed, by weight, of 48.5% barium oxide (BaO), 7.7% calcium oxide, 23.3% boron oxide ($B_2O_3$), and 20.7% silicon dioxide ($SiO_2$).

Alumina rods were coated by being dipped in the resistance material, dried, and then fired over a 30 minute cycle at a peak temperature of 800° C. in a helium atmosphere. The cooled coated rods were cut to the size of individual devices and provided with terminations at their ends. The average sheet resistances and temperature coefficients of resistance (TCR), for the temperature sensing devices are provided below in the Table I.

TABLE I

| Alloy Conductor (wt %) | Pd/Fe Alloy (wt %) | Sheet Resist (ohms/□) | TCR (ppm/°C.) 25–105° C. |
|---|---|---|---|
| 20 | 84/16 | 133 | 4420 |
| 30 | 84/16 | 6 | 5320 |

EXAMPLE II

Resistance materials were made in the same manner as described in Example I, except that iron oxide particles ($Fe_2O_3$) were used instead of the iron metal particles, and the particles were not premilled and alloyed prior to being mixed with the glass frit. Batches of mixtures were made to provide resistance materials with respective total weights of the palladium metal and iron metal of 23.5%, 30% and 50%, and various ratios by weight of palladium metal to iron metal. The devices were made in the same manner as described in Example I, except that the rods coated with the resistance materials were fired at peak temperatures of 750° C., 800° C. and 900° C. over 30 minute cycles in an atmosphere of forming gas of 85% $N_2$ and 15% $H_2$ by volume. The average sheet resistances and temperature coefficients of resistance (TCR), for the temperature sensing devices are shown in the Table II.

TABLE II

| Metal Conductor (wt %) | Pd/Fe (wt %) | Glaze Firing Temp. (°C.) | Sheet Resist (ohms/□) | TCR (ppm/°C.) 25–105° C. |
|---|---|---|---|---|
| 23.5 | 75/25 | 750 | 550 | 4500 |
| | | 800 | 150 | 6050 |
| | | 900 | 6 | 5750 |
| 23.5 | 83/17 | 750 | 470 | 5450 |
| | | 800 | 25K | ±2400 |
| | | 900 | 570 | 5650 |
| 30 | 84/16 | 750 | 28 | 6200 |
| | | 800 | 32 | 5400 |
| | | 900 | 6 | 5000 |
| 50 | 84/16 | 750 | 1 | 5500 |
| | | 800 | 13 | 5800 |
| | | 900 | 0.4 | 6000 |

EXAMPLE III

Resistance materials were made in the same manner as described in Example II, except that the resistance materials had respective total weights of the palladium metal and iron metal conductor of 15%, 25%, 30% and 60%, and a ratio, by weight, of 50% palladium metal to 50% iron metal. The glass frit had a composition, by weight, of 52% barium oxide, 20% boron oxide ($B_2O_3$), 20% silicon dioxide ($SiO_2$), 4% aluminum oxide ($Al_2O_3$), and 4% titanium dioxide ($TiO_2$). The devices were made in the same manner as described in Example II, except that the resistance materials were fired at peak temperatures of 700° C., 800° C., 900° C. and 1000° C. over 30 minute cycles in the forming gas atmosphere. The average sheet resistances and temperature coefficients of resistance (TCR), for the temperature sensing devices are shown in Table III.

TABLE III

| Total Metal Conductor in Glaze (wt %) | Glaze Firing Temp. (°C.) | Sheet Resist (ohms/□) | TCR (ppm/°C.) 25–100° C. |
|---|---|---|---|
| 15 | 900 | * | — |
| | 1000 | 55.1 | 4780 |
| 25 | 700 | * | — |
| | 800 | 35.4 | 5250 |
| | 900 | 4.7 | 5400 |
| | 1000 | 2.2 | 5500 |
| 30 | 900 | 3.7 | 5520 |
| 60 | 700 | 7.4 | 5050 |
| | 800 | 0.4 | 5050 |
| | 900 | 0.4 | 5250 |

TABLE III-continued

| Total Metal Conductor in Glaze (wt %) | Glaze Firing Temp. (°C.) | Sheet Resist (ohms/□) | TCR (ppm/°C.) 25-100° C. |
|---|---|---|---|
| | 1000 | 0.3 | 5150 |

*Non-conductive

EXAMPLE IV

Resistance materials were made in the same manner described in Example III, except that the ratio of the weights of palladium metal to iron metal varied between 25%/75% and 92%/18%. The devices were made in the same manner as described in Example III except that the rods coated with the resistance materials were all fired at 900° C. over 30 minute cycles in forming gas of 85% $N_2$ and 15% $H_2$ by volume. The average sheet resistances and temperature coefficients of resistance (TCR), for the temperature sensing devices are shown in Table IV.

TABLE IV

| Pd in Conductor (wt %) | Total Metal Conductor in Glaze (wt %) | Sheet Resist (ohms/□) | TCR (ppm/°C.) 25-100° C. |
|---|---|---|---|
| 25 | 25 | 6.5 | 2830 |
| 30 | 25 | 322 | 3900 |
| 50 | 15 | * | — |
| 50 | 25 | 4.7 | 5400 |
| 50 | 30 | 3.7 | 5520 |
| 50 | 60 | 0.4 | 5250 |
| 70 | 30 | 9** | 5900 |
| 84 | 30 | 4.4 | 5180 |
| 88 | 30 | 6.4 | 4680 |
| 92 | 30 | 4.5 | 2550 |

*Non conductive
**Fired in 5% $H_2$

EXAMPLE V

Resistance materials were made in the same manner as described in Example III, except that batches of materials were made to provide resistance materials with 25%, 30% and 60% respective total weights of the palladium metal and iron metal conductor, and various ratios of palladium metal and iron metal. The devices were made in the same manner as described in Example III with the coated rods fired at peak temperatures of 700° C., 900° C. and 1000° C. over a 30 minute cycle in an atmosphere of forming gas with hydrogen contents of 5% and 15% by volume. The average sheet resistances and temperature coefficients of resistance (TCR), for the temperature sensing devices are shown in Table V.

TABLE V

| Metal Conductor (wt %) | Pd/Fe (wt %) | Glaze Firing Temp. (°C.) | % $H_2$ in Firing Atmosph | Sheet Resist (ohms/□) | TCR (ppm/°C.) 25-100° C. |
|---|---|---|---|---|---|
| 25 | 50/50 | 900 | 5 | 4.9 | 5100 |
| | | 900 | 15 | 4.7 | 5400 |
| | | 1000 | 15 | 2.2 | 5500 |
| 30 | 70/30 | 900 | 5 | 9.0 | 5900 |
| | 88/12 | 900 | 5 | 3.0 | 4750 |
| | | 900 | 15 | 6.4 | 4700 |
| | | 1000 | 15 | 2.7 | 4950 |
| 60 | 50/50 | 700 | 15 | 7.4 | 5050 |
| | | 900 | 5 | 0.4 | 5100 |
| | | 900 | 15 | 0.4 | 5250 |

TABLE V-continued

| Metal Conductor (wt %) | Pd/Fe (wt %) | Glaze Firing Temp. (°C.) | % $H_2$ in Firing Atmosph | Sheet Resist (ohms/□) | TCR (ppm/°C.) 25-100° C. |
|---|---|---|---|---|---|
| | | 1000 | 15 | 0.3 | 5150 |

EXAMPLE VI

Resistance materials designated Glaze "A" were made in the same manner as described in Example III, except that the batches of materials has 25% total weight of the palladium metal and iron metal conductor, and a ratio by weight of 50% palladium metal to 50% iron metal. Resistance materials designated Glaze "B" were made in the same manner described for Glaze "A", except that iron oxide ($Fe_2O_3$) particles were used instead of iron particles. The devices were made in the same manner as described in Example III, except that the coated rods were fired at a peak temperature of 900° C. for a 30 minute cycle in various nitrogen atmospheres which included a hydrogen content, by volume, of 0%, 1%, 5%, 15%, 30% and 50%. The average sheet resistances and temperature coefficients of resistance (TCR), for the temperature sensing devices are shown in Table VI.

TABLE VI

| Glaze | Metal Conductor (wt %) | Pd/Fe Alloy (wt %) | % $H_2$ in Firing Atmosph | Sheet Resist (ohms/□) | TCR (ppm/°C.) 25-100° C. |
|---|---|---|---|---|---|
| A | 25 | 50/50 | 0 | 170K | −7400 |
| | | | 1 | 6.7 | 5340 |
| | | | 5 | 3.4 | 5320 |
| | | | 15 | 2.9 | 5420 |
| | | | 30 | 2.1 | 5350 |
| | | | 50 | 2.4 | 5340 |
| B | 25 | 50/50 | 0 | 7.0 | 4500 |
| | | | 5 | 9.0 | 5100 |
| | | | 30 | 33.4 | 4320 |
| | | | 50 | 23.6 | 4200 |

EXAMPLE VII

Resistance materials were made in the same manner as described in Example III, except that the resistance materials had total weights of palladium metal and iron metal conductor of 25%, with the ratio by weight of 50% palladium metal to 50% iron metal. The devices were made in the same manner as described in Example III, except that a first division of resistance materials were fired at peak temperatures of 850° C. over a one hour cycle in forming gas of 85% $N_2$ and 15% $H_2$ by volume, and a second division of resistance materials were fired at a peak temperature of 900° C. over a 30 minute cycle in forming gas of 95% $N_2$ and 5% $H_2$ by volume.

Group 1 of the first division of temperature sensing devices were processed by respectively being laser spiraled to have a total resistance of about 500 ohms, provided with a nickel termination film by electroless plating to which conductor leads were soldered, and embedded in a molded jacket. Other groups 2 and 3 of the first division were similarly processed, except that group 2 devices were not embedded in a molded jacket, and group 3 devices were not spiralled. A group 4 of the second division of sensing devices was formed by being diamond spiraled. The average values of resistance at 25° C. and 100° C. indicating the change of total resistance with change in temperature, and the standard deviation of resistance and percent value of deviation exemplifying tolerances for the method of making the temperature sensing devices are shown in Table VII.

TABLE VII

| | Average Value | Standard Deviation | Percent Deviation |
|---|---|---|---|
| Group 1 - Laser Spiraled | | | |
| Resistance (ohms) at | | | |
| 25° C. | 498 | 3.71 | 0.75 |
| 100° C. | 703 | 5.08 | 0.72 |
| TCR (ppm/°C.) | 5489 | 28.5 | 0.52 |
| Group 2 - Laser Spiraled - Unmolded | | | |
| Resistance (ohms) at | | | |
| 25° C. | 498 | 3.24 | 0.65 |
| 100° C. | 702 | 4.47 | 0.64 |
| TCR (ppm/°C.) | 5444 | 36.2 | 0.66 |
| Group 3 - Non-Spiraled | | | |
| Resistance (ohms) at | | | |
| 25° C. | 2.58 | 0.068 | 2.64 |
| 100° C. | 3.62 | 0.095 | 2.62 |
| TCR (ppm/°C.) | 5412 | 46.9 | 0.87 |
| Group 4 - Diamond Spiraled | | | |
| Resistance (ohms) at | | | |
| 25° C. | 493 | 2.38 | 0.48 |
| 100° C. | 689 | 3.49 | 0.51 |
| TCR (ppm/°C.) | 5326 | 25.5 | 0.48 |

EXAMPLE VIII

Resistance materials and devices were made in the same manner as described in Example VII, except that all devices were fired at a peak temperature of 850° C. over a one hour cycle in forming gas of 85% $N_2$ and 15% $H_2$ by volume. The devices were processed by being laser spiraled, terminated and jacketed as group 1 devices of Example VII. Groups of the devices were tested for various temperature ranges extending over 100° C. intervals, temperature readings provided by the devices were recorded, and error was determined by deviation of the readings from a straight line over the particular temperature range being tested. The temperature range, maximum temperature error, and percent value of error for the temperature sensing devices are shown in Table VIII.

TABLE VIII

| Temp Range °C. | Max Temp Error | % Value of Error |
|---|---|---|
| 75→175 | 0.69° C. | 0.32 |
| 50→150 | 0.72° C. | 0.32 |
| 25→125 | 1.13° C. | 0.62 |
| 0→100 | 1.45° C. | 0.68 |
| −25→+75 | −1.53° C. | 0.98 |
| −50→+50 | −2.19° C. | 1.55 |

From the above Examples, there can be seen the effects on the electrical characteristics of the temperature sensing device of the present invention of variations in the composition of the resistor material and the method of making the temperature sensing device. Examples I, II, III, IV and V show the effect of varying the total conducor content, and Examples I, II, IV and V show the effect of varying the ratio of palladium metal to iron metal of the composition. Example II, III and V show the effect of varying the glaze firing temperature and atmosphere, while Example VI shows the effect of varying the hydrogen content of the firing atmosphere between 0 and 50 volume percent. Example I illustrates the use of alloy particles of palladium and iron as the metal conductive constituents of the resistance material, while Example II illustrates the use of palladium metal and iron oxide particles which are not prealloyed as constituents of the resistance material, and Example VI and VII utilize palladium metal and iron metal particles as constituents of the resistance materials. Example I also illustrates the processing of the resistance materials by firing in a helium atmosphere, while the remaining Examples illustrate the use of forming gas and pure nitrogen atmospheres for providing the temperature sensing devices. Examples VII and VIII and their tables illustrate the accuracy in readings obtained by the devices of the invention achieved by various processing techniques including laser spiraling, and diamond spiraling of the coated substrates after they have been fired. Example VII also provides data relating to the characteristics of unspiraled devices, and spiraled devices which are unmolded for testing purposes. Table VIII provides the maximum temperature error, and percentage value of error over ranges of 100° C. of temperature intervals. Thus for each 100° C. interval shown between −50° C. and 175° C., a maximum percentage value of error less than 2% is achieved, while an error of less than 1% is provided for 100° C. temperature intervals between −25° C. and 175° C. This degree of linearity is most desirable, especially when the temperature sensing device is utilized for high accuracy temperature measurements.

From the above, it is noted that the temperature sensing device of the invention achieves its desired objects and can be made from semi-precious materials such as palladium and iron metals and processed by spiraling to provide the desired total resistance. The device can also be efficiently terminated by a nickel coating which may be applied by electroless deposition. The temperature sensing device provides a positive temperature coefficient of resistance which is desirable for preventing a run away condition to which a device having negative temperature coefficients of resistance is subject. The devices of the invention are characterized by the higher temperature coefficient of resistance of pure iron which is aproximately 6500 part per million per °C. rather than the comparatively lower temperature coefficient of palladium of approximately 3700. The devices are also characterized by relatively high sheet resistivities having a high value corresponding to the peak value of temperature coefficient of resistance. This property is most essential for providing temperature sensing devices of sufficiently high total resistance for use in temperature measuring devices. In order to provide a device of practical size with suitably high total resistances, the device is spiraled by utilizing a laser beam or diamond to cut a spiral groove through the coated resistance material and provide an elongated path between the end terminations of the device. Although a pure palladium glaze can be successfully spiraled, a low temperature coefficient of resistance and low resistivity results. The use of a glaze containing iron particles cannot be succesfully spiraled since an attempt to cut the desired groove results in destruction of the glaze conductive network with a resulting open circuit. The device of the invention, however, provides the advantages of high temperature coefficient of resistance and resistivity of the iron metal while still being capable of being spiralled. The devices can also be made having desirable properties by firing in atmospheres using forming gas with contents of hydrogen as low as 5% and 15% by volume, or in other atmospheres affording highly safe firing conditions.

It will thus be seen that the objects set forth above, among those made apparent from the preceding description, are efficiently attained and, since certain changes may be made in the above composition of matter and method without departing from the scope of the invention, it is intended that all matter contained in the above description shall be interpreted illustrative and not in a limiting sense.

What is claimed is:

1. A material for a temperature sensitive device comprising a mixture of glass frit and fine particles containing palladium and iron, the palladium and iron of the fine particles being present in the mixure in an amount having a total weight between about 15% and 65%, and the glass frit being present in an amount between 35% and 85% by weight.

2. A material for a temperature sensitive device comprising a mixture of glass frit and fine particles containing palladium and iron, palladium and iron of the fine particles being present in the mixture in an amount having a total weight between about 25% and 35%.

3. The material for a temperature sensitive device comprising a mixture of glass frit and fine particles containing palladium and iron, the palladium being present in an amount of about 30% to 90% and iron being present in an amount of about 10% to 79% of the total weight of the palladium and iron of the fine particles.

4. A material for a temperature sensitive device comprising a mixture of glass frit and fine particles containing palladium and iron selected from the group consisting of particles of palladium, iron, oxides of palladium and iron, and alloys of palladium and iron, the palladium being present in the amount of about 30% to 90% and iron being present in an amount of about 10% to 70% of the total weight of the palladium and iron of the fine particles.

5. The material in accordance with claim 2 in which the palladium is present in an amount of 30% to 90% and iron is present in an amount of about 10% to 70% of the total weight of the palladium and iron of the fine particles.

6. A material for a temperature sensitive device comprising a mixture of glass frit and fine particles containing palladium and iron, the palladium being present in an amount of about 40% to 85% and iron being present in an amount of about 15% to 60% of the total weight of the palladium and iron of the fine particles.

7. A material for a temperature sensitive device comprising a mixture of glass frit and fine particles containing palladium and iron selected from the group consisting of particles of palladium, iron, oxides of palladium and iron, and alloys of palladium and iron, palladium being present in the amount of about 40% to 85% and iron being present in an amount of about 15% to 60% of the total weight of the palladium and iron of the fine particles.

8. The material in accordance with claim 1, in which palladium is present in an amount of about 40% to 85% and iron is present in an amount of about 15% to 60% of the total weight of the palladium and iron of the fine particles.

9. A material for a temperature sensitive device comprising a mixture of glass frit and fine alloy particles containing palladium and iron, the palladium and iron of the fine particles being present in the mixture in an amount having a total weight between about 15% and 65%, and palladium being present in an amount of about 30% to 90% and iron being present in an amount of between 10% and 70% of the total weight of the palladium and iron of the fine particles.

10. A material for a temperature sensitive device comprising a mixture of glass frit and fine alloy particles containing palladium and iron, the palladium and iron of the fine particles being present in the mixture in an amount having a total weight between about 25% and 30%, and palladium being present in an amount of about 40% to 85% and iron being present in an amount of about 15% to 60% of the total weight of the palladium and iron of the fine particles.

11. The material in accordance with claim 9 in which the glass frit is an alkaline earth borosilicate glass, and the fine particles containing palladium and iron are alloy particles of palladium and iron.

12. The material in accordance with claim 10 in which the glass frit is an alkaline earth borosilicate glass, and the fine particles containing palladium and iron are alloy particles of palladium and iron.

13. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, said palladium and iron of the particles being present in the resistor in an amount having a total weight between about 15% and 65% and glass being present in the amount between about 35% to 85% by weight.

14. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, said palladium and iron of the particles being present in the resistor in an amount having a total weight between about 25% and 30%.

15. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the palladium being present in an amount of about 30% to 90% and the iron being present in an amount of 10% to 70% by weight of the palladium and iron of the particles.

16. The temperature sensitive device in accordance with claim 14 in which palladium is present in an amount of about 30% to 90% and iron is present in an amount of 10% to 70% by weight of the palladium and iron of the particles.

17. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the palladium being present in an amount of about 40% to 85% and the iron being present in an amount of about 15% to 60% of the total weight of the palladium and iron of the particles.

18. The temperature sensitive device in accordance with claim 13 in which palladium is present in an amount of about 40% to 85% and iron is present in an amount of about 15% to 60% of the total weight of the palladium and iron in the particles.

19. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the palladium and iron of the particles being present in the resistor in an amount having a total weight between about 15% and 65%, the palladium being present in an amount of about 30% to 90% and iron being present in an amount of about 10% and 70% of the total weight of the palladium and iron of the particles, and the film of glass being an alkaline earth borosilicate glass.

20. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the palladium and iron of the particles being present in the resistor in an amount having a total weight between about 25% and 30%, the palladium being present in an amount of about 40% to 85% and iron being present in an amount of about 15% and 60% of the total weight of the palladium and iron of the particles, and the film of glass being an alkaline earth borosilicate glass.

21. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the device providing a positive temperature coefficient of resistance of at least about 4000 parts per million per °C. and a sheet resistivity of at least 2 ohms per square.

22. The temperature sensitive device in accordance with claim 19 in which the device provides a positive temperature coefficient of resistance of at least about 4000 parts per million per °C. and a sheet resistivity of at least 2 ohms per square.

23. The temperature sensitive device in accordance with claim 20 in which the device provides a positive temperature coefficient of resistance of at least about 4000 parts per million per °C. and a sheet resistivity of at least 2 ohms per square.

24. A thick film temperature sensitive device characterized by a relatively high positive temperature coefficient of resistance and highly linear resistance to temperature relationship comprising a substrate and a resistor, the resistor including a film of glass on a surface of the substrate which film has embedded therein and dispersed therethroughout conductive particles of palladium and iron comprising an alloy of palladium and iron, the resistance to temperature relationship of the device being highly linear with a deviation of resistance from linearity of not more than 2% for temperature intervals of 100° C. between temperatures of −55° C. and +150° C.

25. The temperature sensitive device in accordance with claim 19 in which the resistance to temperature relationship of the device is highly linear with a deviation of resistance from linearity of not more than 2% for temperature intervals of 100° C. between temperatures of −55° C. and +150° C.

26. The temperature sensitive device in accordance with claim 20 in which the resistance to temperature relationship of the device is highly linear with a deviation of resistance from linearity of not more than 2% for temperature intervals of 100° C. between temperatures of −55° C. and +150° C.

27. A method of making a thick film temperature sensitive device comprising the steps of (a) coating a surface of a substrate with a mixture of glass frit and fine particles containing palladium and iron, the palladium and iron of the fine particles being present in the mixture in an amount between about 15% and 65% by weight;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

28. A method of making a thick film temperature sensitive device comprising the steps of (a) coating a surface of a substrate with a mixture of glass frit and fine particles containing palladium and iron, the fine particles being selected from the group consisting of particles of palladium, iron, oxides of palladium and iron, and alloys of palladium and iron, the palladium and iron of the fine particles being present in the mixture in an amount between about 15% and 65% by weight;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

29. A method of making a thick film temperature sensitive device comprising the steps of (a) coating a surface of a substrate with a mixture of glass frit and fine particles containing palladium and iron, the palladium and iron of the fine particles being present in the mixture in an amount between about 25% and 30% by weight;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

30. A method of making a thick film temperature sensitive device comprising the steps of (a) coating a surface of the substrate with a mixture of glass frit and fine particles containing palladium and iron, the palladium being present in an amount of between about 30% and 90% and iron being present in an amount of between about 10% and 70% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

31. A method of making a thick film temperature sensitive device comprising the steps of (a) coating a surface of the substrate with a mixture of glass frit and fine particles containing palladium and iron, the fine particles being selected from the group consisting of particles of palladium, iron, oxides of palladium and iron, and alloys of palladium and iron, the palladium being present in an amount of between about 30% and 90% and iron being present in an amount of between about 10% and 70% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

32. The method in accordance with claim 29 in which palladium is present in an amount of between about 30% and 90% and iron is present in an amount of between about 10% and 70% of the total weight of the palladium and iron of the fine particles.

33. A method of making a thick film temperature sensitive device comprising the steps of (a) coating a surface of a substrate with a mixture of glass frit and fine particles containing palladium and iron, the palladium being present in an amount of between about 40% and 85% and iron being present in an amount of between about 15% and 60% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

34. A method of making a thick film temperature sensitive device comprising the steps of (a) coating a surface of a substrate with a mixture of glass frit and fine particles containing palladium and iron, the fine particles being selected from the group consisting of particles of palladium, iron, oxides of palladium and iron, and alloys of palladium and iron, the palladium being present in an amount of between about 40% and 85% and iron being present in an amount of between about 15% and 60% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

35. The method in accordance with claim 28 in which the palladium is present in an amount of between about 40% and 85% and iron is present in an amount of between about 15% and 60% of the total weight of the palladium and iron of the fine particles.

36. A method of making a thick film temperature sensitive device comprising the steps of (a) coating a surface of a substrate with a mixture of glass frit and fine particles containing palladium and iron, the palladium and iron of the fine particles being present in the mixture in an amount between about 15% and 65% by weight of the mixture, and palladium being present in an amount of between about 30% and 90% and iron being present in an amount of between about 10% and 70% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

37. A method of making a thick film temperature sensitive device comprising the steps of (a) coating a surface of a substrate with a mixture of glass frit and fine particles containing palladium and iron, the palladium and iron of the fine particles being present in the mixture in an amount between about 25% and 30% by weight of the mixture, and palladium being present in an amount of between about 40% and 85% and iron being present in an amount of between about 15% and 60% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

38. A method of making a thick film temperature sensitive device comprising the steps of (a) coating the surface of a substrate with a mixture of glass frit and fine particles containing palladium and iron;

(b) firing the mixture in a reducing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

39. The method in accordance with claim 38 in which the reducing atmosphere is forming gas.

40. The method in accordance with claim 39 in which the atmosphere of forming gas has a hydrogen content of not greater than 15% by volume.

41. A thick film temperature sensitive device characterized by a relatively high positive coefficient of resistance and highly linear resistance to temperature relationship made by (a) coating a surface of a substrate with a mixture of glass frit and fine particles containing palladium and iron, the palladium and iron of the fine particles being present in the mixture in an amount between about 15% and 65% by weight;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

42. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the palladium and iron of the fine particles being present in the mixture in an amount between about 25% and 30% by weight;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

43. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the palladium being present in an amount of between about 30% and 90% and the iron being present in an amount of between about 10% and 70% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

44. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the fine particles being selected from the group of particles consisting of palladium, iron, oxides of palladium and iron, and alloys of palladium and iron, the palladium being present in an amount of between about 30% and 90% and iron being present in an amount of between about 10% and 70% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

45. The temperature sensitive device according to claim 42 in which palladium is present in an amount of between about 30% and 90% and iron is present in an amount of between about 10% and 70% of the total weight of the palladium and iron of the fine particles.

46. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the palladium being present in an amount of between about 40% and 85% and the iron being present in an amount of between about 15% and 60% of the total weight of the palladium and iron in the fine particles;

(b) firing the mixture in a non-oxidizing atmosphere at a temperature of between about 700° C. and 1100° C. to soften the glass and provide alloy particles of palladium and iron therein; and (c) cooling the coated substrate to form a resistor film of glass having conductive alloy particles of palladium and iron dispersed therethroughout.

47. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the fine particles being selected from the group of particles consisting of palladium, iron, oxides of palladium and iron, and alloys of palladium and iron, the palladium being present in an amount of between about 40% and 85% and the iron being present in an amount of between about 15% and 60% of the total weight of the palladium and iron in the fine particles;

(b) firing the mixture in a non-oxidizing atmosphere at a temperature of between about 700° C. and 1100° C. to soften the glass and provide alloy particles of palladium and iron therein; and (c) cooling the coated substrate to form a resistor film of glass having conductive alloy particles of palladium and iron dispersed therethroughout.

48. The temperature sensitive device according to claim 41 in which the palladium is present in an amount of between about 40% and 85% and iron is present in an amount of between about 15% and 60% of the total weight of the palladium and iron of the fine particles.

49. A thick film temperature sensitive device characterized by a relatively high positive temperature coefficient of resistance and highly linear resistance to temperature relationship made by (a) coating a surface of a substrate with a mixture of glass frit and fine particles containing palladium and iron, the metals of the fine particles being present in the mixture in an amount between about 15% and 65% by weight of the mixture, and palladium being present in an amount of between about 30% and 90% and iron being present in an amount of between about 10% and 70% of the total weight of the palladium and iron of the fine particles;

(b) firing the mixture in a non-oxidizing atmosphere at a temperature between about 700° C. and 1100°

C. to soften the glass and provide alloy particles of palladium and iron therein; and (c) cooling the coated substrate to form a resistor film of glass having conductive alloy particles of palladium and iron dispersed therethroughout.

50. A thick film temperature sensitive device characterized by a relatively high positive temperature coefficient of resistance and highly linear resistance temperature relationship made by (a) coating a surface of a substrate with a mixture of glass frit and fine particles containing palladium and iron, the metals of the fine particles being present in the mixture in an amount between about 25% and 30% by weight of the mixture, and palladium being present in an amount of between about 40% and 85% and iron being present in an amount of between about 15% and 60% of the total weight of the palladium and iron of the fine particles;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout.

51. A thick film temperature sensitive device characterized by a relatively high positive temperature coefficient of resistance and highly linear resistance to temperature relationship made by (a) coating a surface of a substrate with a mixture of glass frit and fine particles containing palladium and iron;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout, the temperature sensitive device providing a positive temperature coefficient of resistance of at least about 4000 parts per million per °C. and a sheet resistivity of at least 2 ohms per square.

52. The temperature sensitive device according to claim 49 in which the device provides a positive temperature coefficient of resistance of at least about 4000 part per million per °C. and a sheet resistivity of at least 2 ohms per square.

53. The temperature sensitive device according to claim 50 in which the device provides a positive temperature coefficient of resistance of at least about 4000 parts per million per °C. and a sheet resistivity of at least 2 ohms per square.

54. A thick film temperature sensitive device characterized by a relatively high positive coefficient of resistance and highly linear resistance to temperature relationship made by (a) coating a surface of a substrate with a mixture of glass frit and fine particles containing palladium and iron;

(b) firing the mixture in a non-oxidizing atmosphere at a temperature between about 700° C. and 1100° C. to soften the glass and provide alloy particles of palladium and iron therein; and (c) cooling the coated substrate to form a resistor film of glass having conductive alloy particles of palladium and iron dispersed therethroughout, the resistance to temperature relationship of the device being highly linear with a deviation of resistance from linearity of not more than 2% for temperature intervals of 100° C. between temperatures of −55° C. and +150° C.

55. The temperature sensitive device according to claim 49 in which the resistance to temperature relationship of the device is highly linear with a deviation of resistance from linearity of not more than 2% for temperature intervals of 100° C. between temperatures of −55° C. and +150° C.

56. The temperature sensitive device according to claim 50 in which the resistance to temperature relationshp of the device is highly linear with a deviation of resistance from linearity of not more than 2% for temperature intervals of 100° C. between temperatures of −55° C. and +150° C.

* * * * *